US007273037B2

(12) United States Patent
Kondo

(10) Patent No.: US 7,273,037 B2
(45) Date of Patent: Sep. 25, 2007

(54) WIRE HARNESS MOUNTING STRUCTURE FOR FUEL DISTRIBUTOR PIPE

(75) Inventor: Yasushi Kondo, Kanagawa (JP)

(73) Assignee: Keihin Corporation, Tokyo (JP)

( * ) Notice: Subject to any disclaimer, the term of this patent is extended or adjusted under 35 U.S.C. 154(b) by 19 days.

(21) Appl. No.: 11/283,811

(22) Filed: Nov. 22, 2005

(65) Prior Publication Data

US 2006/0124109 A1 Jun. 15, 2006

(30) Foreign Application Priority Data

Dec. 10, 2004 (JP) ..... 2004-357551

(51) Int. Cl.
*F02M 69/46* (2006.01)

(52) U.S. Cl. ..... 123/456; 123/469; 123/447; 123/472; 248/49

(58) Field of Classification Search ..... 123/456, 123/469, 472, 447; 248/49
See application file for complete search history.

(56) References Cited

U.S. PATENT DOCUMENTS 4,950,171 A * 8/1990 Muzslay ..... 439/76.1
5,046,464 A * 9/1991 Hisatomi et al. ..... 123/143 C
5,086,743 A * 2/1992 Hickey ..... 123/468
5,197,675 A * 3/1993 Daly ..... 239/585.2
5,238,415 A * 8/1993 Bittner et al. ..... 439/130
5,390,638 A * 2/1995 Hornby et al. ..... 123/456
6,167,855 B1 * 1/2001 Mammarella et al. ... 123/90.38
6,189,511 B1 * 2/2001 Dzierzawski et al. ..... 123/472
6,502,552 B2 * 1/2003 Lee ..... 123/456
6,622,700 B2 * 9/2003 Lee et al. ..... 123/456
6,675,755 B2 * 1/2004 Glovatsky et al. ..... 123/143 C
2007/0023585 A1 * 2/2007 Judd et al. ..... 248/49

* cited by examiner

*Primary Examiner*—Stephen K. Cronin
*Assistant Examiner*—J. Page Hufty
(74) *Attorney, Agent, or Firm*—Bacon & Thomas, PLLC

(57) ABSTRACT

Wire harness mounting structure for fuel distributor pipe comprises at least one pair of first and second guide claws provided on an outer periphery of the fuel distributor pipe with having a space along the longitudinal axis thereof, the first guide claw has a first wire harness support groove opened to one side, and the second guide claw has a second wire harness support groove opened to opposite side, the wire harness extending from the female type connector is inserted and retained in the first and second wire harness support grooves of the first and second guide claws, respectively, whereby additional mounting members for assembling is not required, and the assembling operation can be performed readily.

2 Claims, 6 Drawing Sheets

WIRE HARNESS MOUNTING STRUCTURE FOR FUEL DISTRIBUTOR PIPE

FIELD OF THE INVENTION

The present invention relates to a fuel injection apparatus for supplying pressurized fuel to an engine via a fuel injection valve wherein fuel in a storage tank is pressurized by a fuel pump and more particularly to wire harness mounting structure for a fuel distributor pipe wherein a wire harness extends from a female type connector engaged to a male type connector of the fuel injection valve mounted to the fuel distributor pipe.

BACKGROUND OF THE INVENTION

A conventional wire harness mounting structure for the fuel distributor pipe is shown in FIG. 9.

A fuel distributor pipe D has a fuel distribution passage 30 formed in a direction along the longitudinal axis X-X thereof and injection valve support holes (not shown) provided through to the fuel distribution passage 30. Fuel injection valves J are inserted into the injection valve support holes and retained therein.

A male type connector Ja is formed integrally with the fuel injection valve J to protrude outside, to which a female type connector Z provided with a wire harness W is engagedly connected. The wire harness W is connected to an external power source not shown. An electric signal from the power source is transmitted to a solenoid coil not shown provided in the fuel injection valve J through the wire harness W, female type connector Z and male type connector Ja, so that the fuel injection valve J supplies fuel to an engine in response to the electric signal.

The wiring harness W extending from the female type connector to the external power source it is fastened on the outer periphery of the fuel distributor pipe D by means of a band 31 made of synthetic resin material.

Such fastening of the wire harness W on the fuel distributor pipe D by the band 31 is to prevent interference with surrounding component. Specifically, this is necessary from the viewpoint of preventing physical contacts of the wire harness W with external objects, and from the viewpoint of improving an exterior appearance, since the wire harness W for the motorcycle is exposed directly to the atmosphere.

According to such conventional wire harness mounting structure for the fuel distributor pipe, it is necessary to fasten the band 31 after winding it around the wire harness W and the fuel distributor pipe D, and after the fastening operation, the leading edge of the band 31 has to be cut.

Thus, it is difficult to improve the workability, since man-hours for fastening the band 31 and for cutting the band 31 is inevitable. Further, the number of components is increased due to the provision of the band 31.

Further, unevenness due to manual fastening manner easily occurs, resulting in unevenness of the attaching position of the wire harness W. Specifically, as for the motorcycle in which the wiring harness W is exposed directly to the atmosphere, the commercial value is reduced.

Furthermore, unevenness of the fastening force easily occurs, resulting in unevenness of slack of the wire harness W. Moreover, the band 31 has to be removed during the maintenance or inspection of the fuel injection valve J, resulting in poor workability of maintenance or inspection operation.

SUMMARY OF THE INVENTION

The present invention of a wire harness mounting structure for a fuel distributor pipe is done in view of the above-mentioned drawbacks, and a primary object of the present invention is to provide a wire harness mounting structure for the fuel distributor pipe wherein there is no necessity to provide additional parts for mounting the wire harness, and capable of easily positioning and fixing the wire harness to the fuel distributor pipe.

To attain the above object, one aspect of the present invention is to provide a wire harness mounting structure for a fuel distributor pipe having a fuel distribution passage formed inside along the longitudinal axis thereof, and injection valve support holes provided toward the fuel distribution passage for fuel injection valves being inserted and retained therein, comprising;

at least one pair of first and second guide claws provided on an outer periphery of the fuel distributor pipe with being spaced along the longitudinal axis thereof, a first wire harness support groove provided in said first guide claw so as to have an opening opened to one side, a second wire harness support groove provided in said second guide claw so as to have an opening opened to another side opposite to the one side, and a wire harness, which has a female type connector engagedly connected to the male type connector of the fuel injection valve, being inserted and retained in the first and second wire harness support grooves of the first and second guide claws, respectively.

Another aspect of the present invention is, in addition to said aspect, to provide harness mounting structure for the fuel distributor pipe, wherein the fuel distributor pipe is formed by injection molding with a fixed mold and a movable mold, and the first and second wire harness support grooves of the first and second guide claws are formed by molding only.

According to the first aspect of the present invention, the external power source and the fuel injection valve are electrically connected to each other by engagedly connecting the female type connector with the male type connector formed in the fuel injection valve mounted to the fuel distributor pipe. The wire harness extending from the female connector is inserted and retained to the first wire harness support groove from the opening of the one side of the first guide claw, and then inserted and retained to the second wire harness support groove from the opening of the other side of the second guide claw.

With such arrangement, the wire harness is restrained from shifting in one side direction by the second wire harness support groove, and restrained from shifting in the opposite side direction by the first wire harness support groove, thereby the wire harness is retained at a predetermined position on the fuel distributor pipe.

For assembling the wire harness on the fuel distributor pipe, it can be done simply by inserting the wire harness to the first and the second wire harness support groove of a pair of the guide claws integrally formed on the fuel distributor pipe. Thus, the assembling operation can be performed readily, and the number of man-hours for the assembling operation can be reduced.

Further, there is no need to prepare particular mounting members in addition for the assembling operation. Therefore, the number of parts can be reduced in comparison with the conventional wire harness mounting structure.

Furthermore, since a pair of the guide claws for mounting the wire harness is fixedly disposed at a predetermined position of the fuel distributor pipe, the wire harness can be constantly retained on the fuel distributor pipe in the predetermined position exactly, when assembling.

Moreover, for the maintenance of the fuel injection valve, the wire harness is detached from the guide claws, and after then, the wire harness is inserted again to the guide claws.

Thus, since the wire harness can be detached from and inserted to the guide claws repeatedly, workability of the maintenance operation can be highly improved.

According to the second aspect of the present invention, the fuel distributor pipe is formed by injection molding employing fixed and movable molds, and the first and second guide claws provided with the wire harness support grooves are simultaneously formed by only molding with the fixed and movable molds.

Therefore, the first and second guide claws can be readily formed simultaneously with the formation of the fuel distributor pipe by injection molding.

DETAILED DESCRIPTION OF THE PREFERRED EMBODIMENTS

An embodiment of the wire harness mounting structure for a fuel distributor pipe according to the present invention is described hereinafter with reference to the accompanying drawings.

Referring to FIGS. 1-4, a fuel distributor pipe D is described.

Figure 1:
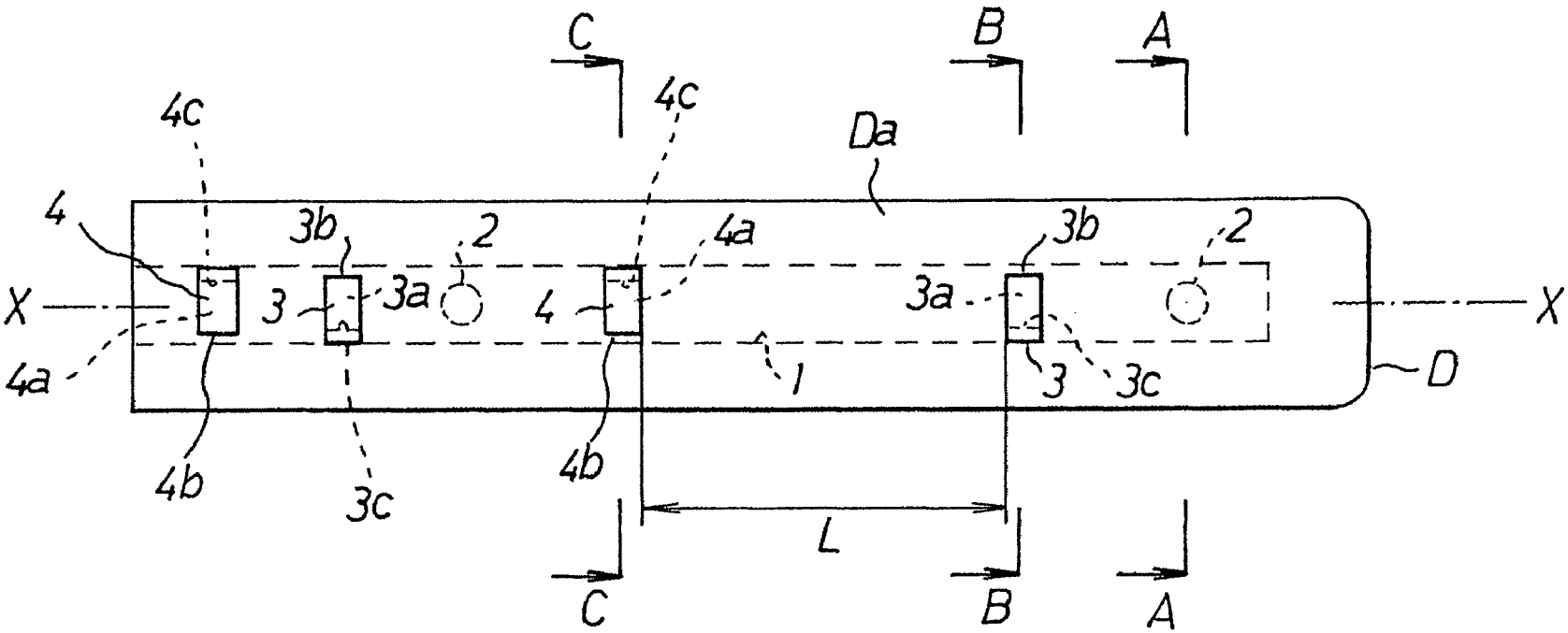
FIG. 1 is a top plan view showing an embodiment of a fuel distributor pipe used for a wire harness mounting structure for a fuel distributor pipe according to the present invention.
Figure 2:
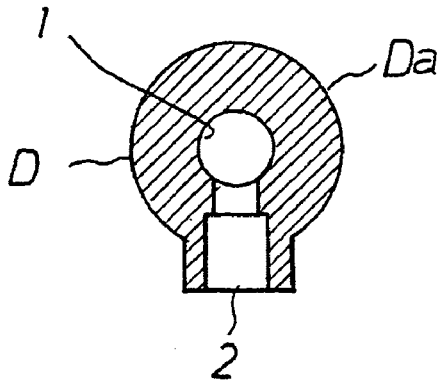
FIG. 2 is a longitudinal section along the line A-A in FIG. 1.
Figure 3:
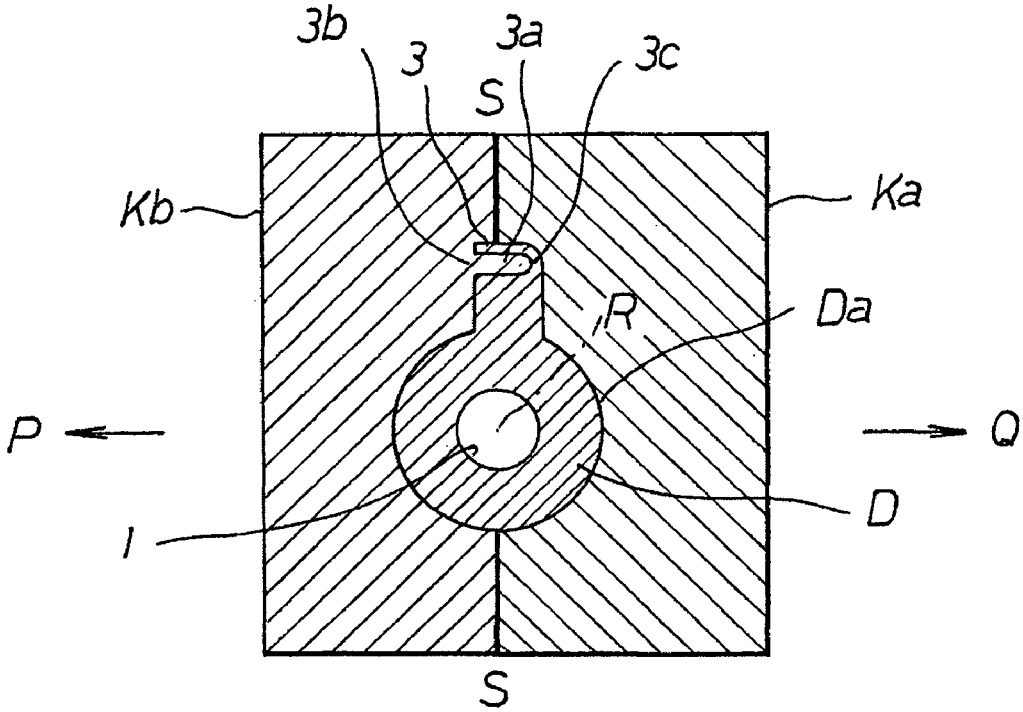
FIG. 3 is a longitudinal section along the line B-B in FIG. 1.
Figure 4:
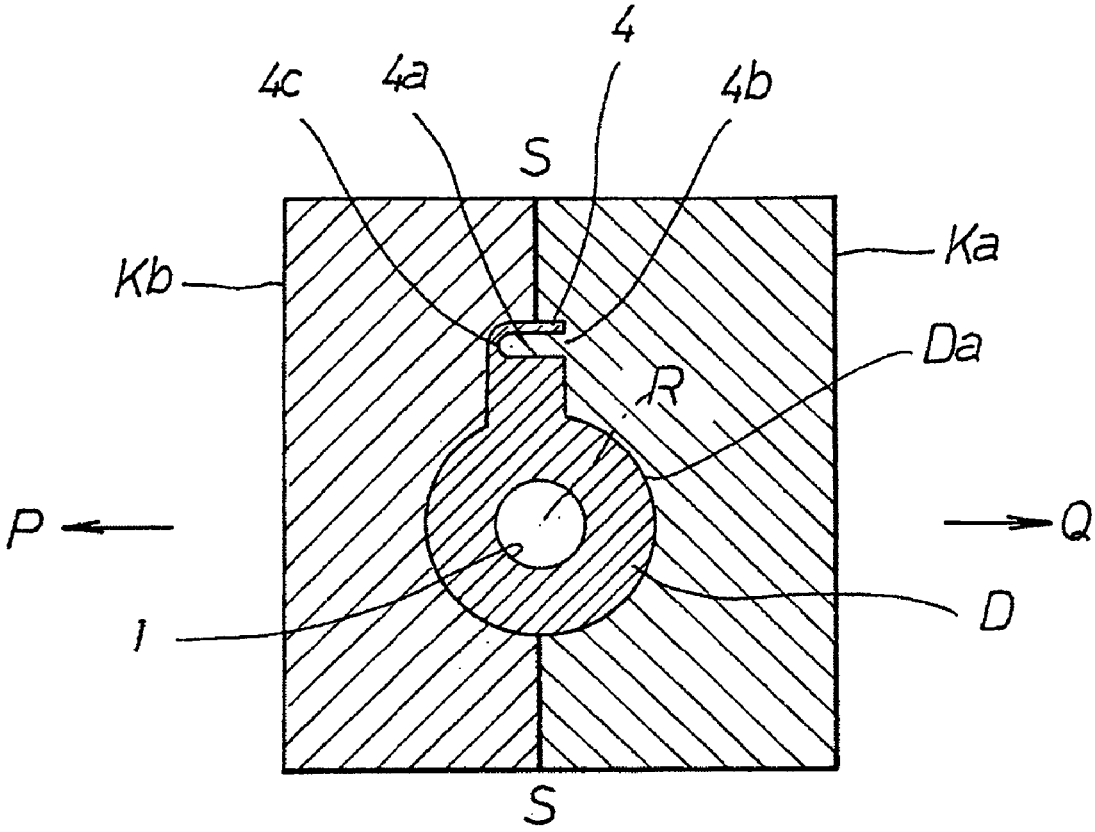
FIG. 4 is a longitudinal section along the line C-C in FIG. 1.
Figure 5:
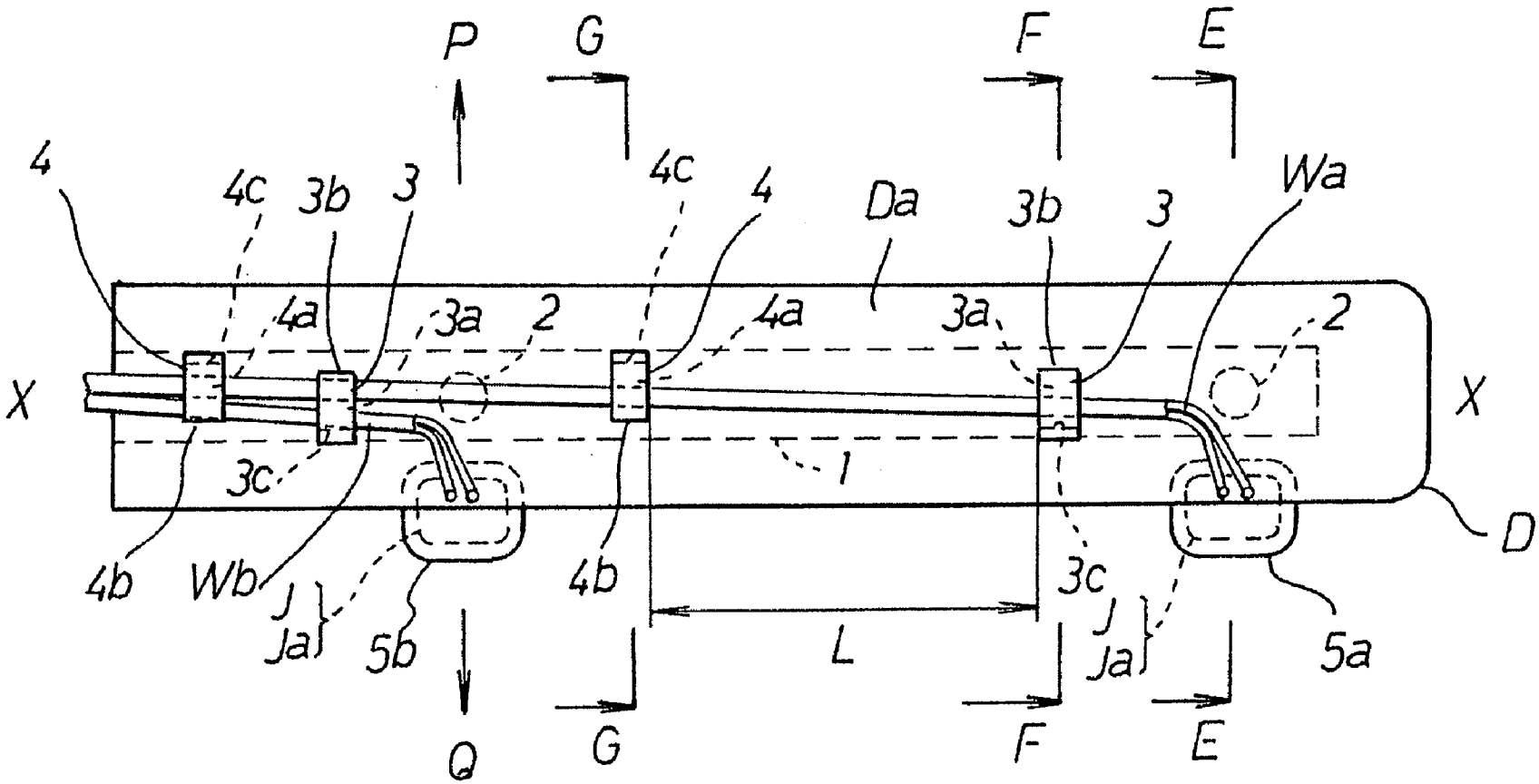
FIG. 5 is a top plan view showing of an embodiment of the wire harness mounting structure for a fuel distributor pipe according to the present invention.

FIG. 1 is a top plan view of a fuel distributor pipe D,

FIG. 2 is a longitudinal section along the line A-A in FIG. 1, FIG. 3 is a longitudinal section along the line B-B in FIG. 1, and FIG. 4 is a longitudinal section along the line C-C in FIG. 1.

The fuel distributor pipe D has a fuel distribution passage 1 provided along the longitudinal axis X-X thereof wherein a left end of the passage 1 opens to the left side.

The reference numeral 2 designates fuel injection valve support holes to which a fuel injection valve (which will be described later) is inserted tightly. A lower end of the hole opens downward and an upper end thereof communicates to the fuel distribution passage 1.

In this embodiment, there are provided two fuel injection valve support holes 2 with having a space along the longitudinal axis X-X. The fuel injection valve support holes are shown in FIG. 2.

On an outer periphery Da of the fuel distributor pipe D, at least one pair of guide claws 3, 4 are formed integrally with the fuel distributor pipe D.

The pair of the guide claws are referred hereinafter to a first guide claw 3 and second guide claw 4 for simplifying the explanation. The first and second guide claws 3 and 4 are provided on the outer periphery Da of the fuel distributor pipe D so as to protrude, to be spaced at a distance L along the longitudinal axis X-X of the fuel distribution passage 1 and to oppose to each other.

Referring now to FIG. 3, the first guide claw 3 is formed at an upper position of the outer periphery Da of the fuel distributor pipe D so as to protrude. The first guide claw 3 has a first wire harness support groove 3*a* so as to have an opening 3*b* opened to one side P (left side as shown in FIG. 3) with such a width that the wire harness extending from a female type connector, which will be described later, can be inserted.

A bottom portion 3*c* of the first wire harness support groove 3*a* is positioned at another side Q (right side as shown in FIG. 3) of the vertical line S-S passing through the center axis R of the fuel distribution passage 1 and the opening 3*b* is positioned at the one side P (left side as shown in FIG. 3) of the vertical line S-S.

Referring to FIG. 4, the second guide claw 4 is formed at an upper position of the outer periphery Da of the fuel distributor pipe D so as to protrude. The second guide claw 4 has a second wire harness support groove 4*a* so as to have an opening 4*b* opened to the other side Q (rightward as shown in FIG. 4) with such a width that the wire harness extending from the female type connector can be inserted.

A bottom portion 4*c* of the second wire harness support groove 4*a* is positioned at the one side P (left side as shown in FIG. 4) of the vertical line S-S passing through the center axis R of the fuel distribution passage 1 and the opening 4*b* is positioned at the other side Q (right side as shown in FIG. 4) of the vertical line S-S.

The fuel distributor pipe D including the above-mentioned first and second guide claws 3 and 4 is formed by injection molding by means of the fixed mold Ka and movable mold Kb with the vertical line S-S being a parting line thereof.

In addition, the fuel distribution passage 1 and the fuel injection valve support holes 2 are formed by molding with using core molds.

In this embodiment, the description is made about the pair of guide claws 3 and 4 corresponding to the fuel injection valve support hole 2 disposed at the left side. Since the structure of the other pair of guide claws disposed at the right side is similar to that at the left side, the description thereof is omitted but the same reference numerals are used.

Figure 6:
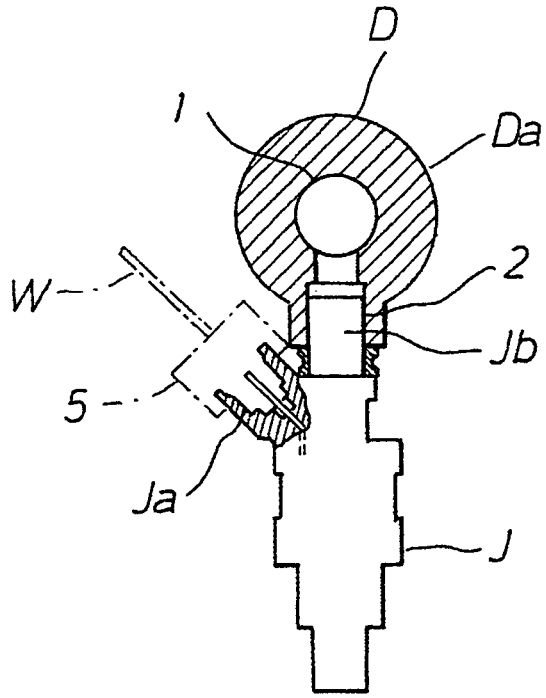
FIG. 6 is a longitudinal section along the line E-E in FIG. 5.

When assembling the wire harness on the fuel distributor pipe D, A rear end Jb of the fuel injection valve J is inserted to the fuel injection valve support hole 2 of the fuel distributor pipe D formed as above mentioned and supported airtightly, and the female type connector 5 provided with the harness W is engagedly connected to the male connector Ja protruding outwardly from the fuel injection valve J as shown in FIG. 6.

In this embodiment, there are provided two fuel injection valves J along the longitudinal axis X-X, and the first female type connector 5*a* is engagedly connected to the male type connector Ja of the fuel injection valve J at the right side, while the second female type connector 5*b* is engagedly connected to the male type connector Ja of the fuel injection valve J at the left side.

Further, a proximal end side of the first wire harness Wa extending from the first female type connector 5*a* is inserted from the opening 3*b* opened to the one side P of the first guide claw 3 toward the bottom portion 3*c* of the first wire harness support groove 3*a* to be placed at the other side Q, and then the front end side of the first wire harness Wa is inserted from the opening 4*b* opened to the other side Q of the second guide claw 4 toward the bottom portion 4*c* of the second wire harness support groove 4*a* to be placed at the one side P.

Figure 7:
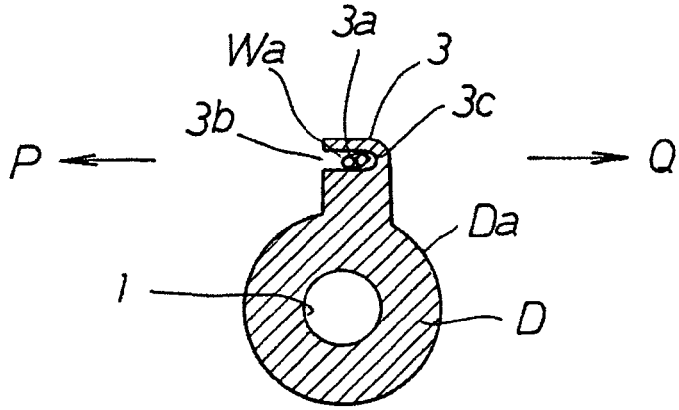
FIG. 7 is a longitudinal section along the line F-F in FIG. 5.
Figure 8:
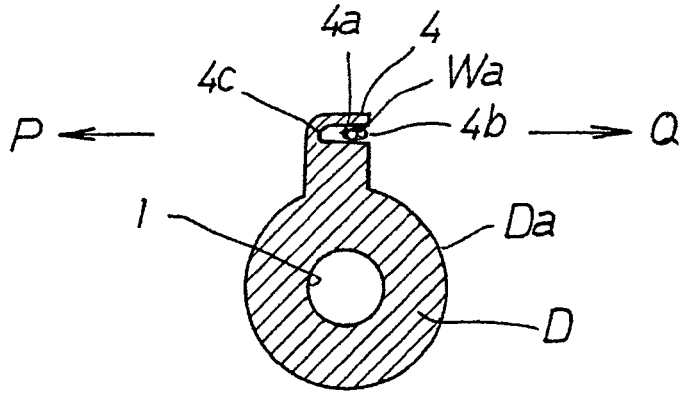
FIG. 8 is a longitudinal section along the line G-G in FIG. 5.
Figure 9:
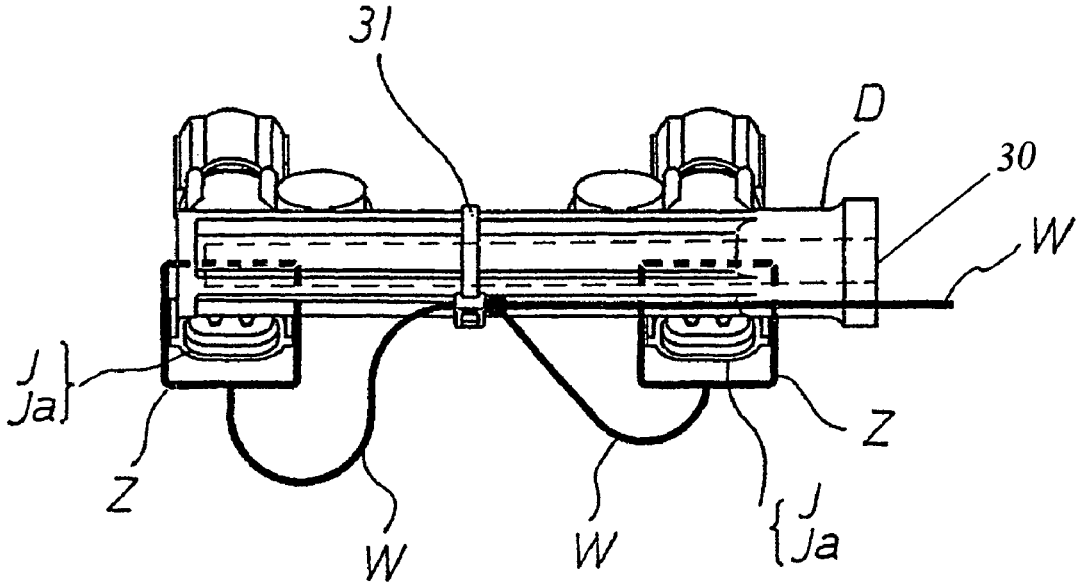
FIG. 9 PRIOR ART
FIG. 9 is a top plan view showing a conventional wire harness mounting structure for a fuel distributor pipe.

The first wire harness Wa inserted in the first wire harness support groove 3*a* is shown in FIG. 7, while the first wire harness Wa inserted in the second wire harness support groove 4*a* is shown in FIG. 8.

In this case, the most front end side of the first wire harness Wa is inserted to the wire harness support grooves 3*a* and 4*a* of the first and second guide claws 3 and 4 formed at the left side of the second female connector 5*b*.

Therefore, the first wire harness Wa connected to the first female type connector 5*a* is inserted and retained in the first wire harness support groove 3*a* of the first guide claw 3 to be restrained against shifting toward the other side Q beyond the bottom portion 3*c*, and the first wire harness Wa is inserted and retained in the second wire harness support groove 4*a* of the second guide claw 4 to be restrained against shifting toward the one side P beyond the bottom portion 4*c*, thereby the first wire harness Wa is fixed at a predetermined position on the fuel distributor pipe D without shifting too much.

A plural pairs of guide claws comprising first and second guide claws may be provided, thereby the wire harness is mounted more securely in a predetermined range position on the fuel distributor pipe D.

Just like the first wire harness Wa, the second wire harness Wb extending from the second female type connector 5*b* is fixed in a predetermined position on the fuel distributor pipe D, by the pair of the guide claws (the first and second guide claw 3 and 4) disposed at the left side of the second female type connector 5*b*.

As described above, according to the present invention, since at least one pair of first and second guide claws are provided on the outer periphery of the fuel distributor pipe with being spaced along the longitudinal axis thereof, a first wire harness support groove having an opening opened to one side is provided in the first guide claw and a second wire harness support groove having an opening opened to another side opposite to the one side is provided in the second guide claw, and the wire harness having female type connector is inserted and retained in the first and second wire harness support grooves, the wire harness can be fixed securely in a predetermined range of position on the fuel distributor pipe.

Further, since the pair of the guide claws are formed integrally on the outer periphery of the fuel distributor pipe, there is no need to prepare additional mounting members for assembling, and since the wire harness can be fixed by only inserting the wire harness to the first and second wire harness support grooves of the first and second guide claws, the number of parts and the number of man-hours for assembling can be reduced.

Moreover, due to the integral formation of the guide claws with the fuel distributor pipe, the guide claws have enough durability for repeated detachment and attachment of the wire harness to the guide claws. Therefore, workability of the maintenance operation can be highly improved and a long-term use becomes possible.

What is claimed is:

1. The wire harness mounting structure for a fuel distributor pipe having a fuel distribution passage formed inside along the longitudinal axis thereof and injection valve support holes provided toward to the fuel distribution passage for fuel injection valves being inserted and retained therein, comprising;

a first guide claw which has a bottom portion positioned at a first side spaced from a vertical line passing through a center axis of the fuel distribution passage and a first wire harness support groove with an opening opened towards a second side spaced from said vertical line;

a second guide claw which has a bottom portion positioned at the second side spaced from the vertical line passing through the center axis of the fuel distribution passage and a second wire harness support groove with an opening opened towards the first side spaced from said vertical line, the first and second guide claws being provided on an outer periphery of the fuel distributor pipe so as to oppose each other and being spaced from each other along a longitudinal axis of the fuel distribution passage; and a wire harness which extends from a female type connector engagedly connected to a male type connector of the fuel injection valve, the wire harness being inserted and retained in the first wire harness support groove via the opening of the first guide claw from the second side, and also being inserted and retained in the second wire harness support groove via the opening of the second guide claw from the first side.

2. Wire harness mounting structure as claimed in claim 1, wherein the fuel distributor pipe is formed by injection molding with a fixed mold and a movable mold, and the first and second wire harness support grooves provided with the openings are formed by molding only.

* * * * *